US007870879B2

(12) United States Patent
Koskovich

(10) Patent No.: US 7,870,879 B2
(45) Date of Patent: Jan. 18, 2011

(54) AUTOMATED SYSTEM FOR PRECISION CUTTING CROOKED LUMBER

(75) Inventor: Jerome E. Koskovich, Byron, MN (US)

(73) Assignee: Mitek Holdings, Inc., Wilmington, DE (US)

( * ) Notice: Subject to any disclaimer, the term of this patent is extended or adjusted under 35 U.S.C. 154(b) by 176 days.

(21) Appl. No.: 11/994,309

(22) PCT Filed: Jun. 28, 2006

(86) PCT No.: PCT/US2006/025255

§ 371 (c)(1),
(2), (4) Date: Apr. 8, 2008

(87) PCT Pub. No.: WO2007/002788

PCT Pub. Date: Jan. 4, 2007

(65) Prior Publication Data

US 2008/0184856 A1 Aug. 7, 2008

Related U.S. Application Data

(60) Provisional application No. 60/694,780, filed on Jun. 28, 2005.

(51) Int. Cl.
*B27L 1/00* (2006.01)

(52) U.S. Cl. ..... 144/363; 144/376; 144/379; 144/394; 144/404; 144/3.1; 83/75.5

(58) Field of Classification Search ..... 144/363, 144/376, 379, 2.1, 3.2, 1.1, 382, 392, 394, 144/402, 404, 3.1; 83/74, 75.5, 364, 72
See application file for complete search history.

(56) References Cited

U.S. PATENT DOCUMENTS

| | | | | |
|---|---|---|---|---|
| 3,910,142 | A * | 10/1975 | Jureit et al. | 83/74 |
| 4,546,440 | A | 10/1985 | Palmberg | |
| 4,640,160 | A * | 2/1987 | Hards | 83/75.5 |
| 4,840,207 | A | 6/1989 | Lines | |
| 4,846,923 | A | 7/1989 | Lines | |
| 4,941,100 | A * | 7/1990 | McFarlane et al. | 700/167 |
| 5,449,030 | A | 9/1995 | Mutsuura | |

(Continued)

FOREIGN PATENT DOCUMENTS

WO 2007002788 A2 1/2007

OTHER PUBLICATIONS

Search Report dated Aug. 3, 2009 regarding EP06799972, 6 pages.

(Continued)

*Primary Examiner*—Shelley Self
(74) *Attorney, Agent, or Firm*—Senniger Powers LLP

(57) ABSTRACT

An automated saw system for cutting a crooked piece of lumber with a mitered end and a length. The saw system includes a saw for cutting the piece of lumber, a lumber feed conveyor for feeding the piece of lumber to the saw, and a sensor that measures a deviation amount by which the piece of lumber deviates from an idealized straight piece of lumber. A controller communicates with the sensor to adjust either the saw or the conveyor in response to the detected deviation amount so that the piece of lumber is cut to correspond to a cut of the idealized straight piece of lumber.

18 Claims, 10 Drawing Sheets

U.S. PATENT DOCUMENTS

| | | | | |
|---|---|---|---|---|
| 5,722,474 | A | 3/1998 | Raybon | |
| 5,934,866 | A | 8/1999 | Redden | |
| 6,240,821 | B1 * | 6/2001 | Landers et al. | 83/364 |
| 6,615,100 | B1 * | 9/2003 | Urmson | 700/167 |
| 6,651,306 | B1 | 11/2003 | LePoire | |
| 6,666,367 | B1 | 12/2003 | Ohnesorge | |
| 6,817,392 | B2 | 11/2004 | Phillips | |
| 6,994,241 | B1 | 2/2006 | Ohnesorge | |
| 7,011,006 | B2 | 3/2006 | Koskovich | |
| 7,093,350 | B2 | 8/2006 | McNeelege | |
| 7,093,628 | B2 | 8/2006 | Kelly | |
| 2002/0152861 | A1 | 10/2002 | Conry | |

OTHER PUBLICATIONS

International Search Report for Application No. PCT/US06/25255, dated Dec. 18, 2006; 9 pages.

* cited by examiner

AUTOMATED SYSTEM FOR PRECISION CUTTING CROOKED LUMBER

REFERENCE TO RELATED APPLICATIONS

This application is the U.S. National application of PCT/US2006/025255 filed on Jun. 28, 2006.

FIELD OF THE INVENTION

The invention relates to lumber processing equipment. More particularly, the invention relates to equipment for the automated cutting of lumber.

BACKGROUND OF THE INVENTION

Rising labor costs and demands for more time and cost efficient construction have made it desirable to construct building components and modules off-site at specialized fabrication facilities. With wood frame structures, especially prefabricated residential structures, there are great economies to be realized by providing equipment that can automatically measure and cut the multiple different lumber components utilized in wall panels, roof trusses, floor trusses, and other prefabricated structures. Where significant quantity of a particular structural element, such as a roof trusses, is needed, the use of such automated equipment can greatly decrease construction time and lower cost. The economies of this approach are very appealing for custom structural designs. For wood structures where the framing is constructed on site, precutting and marking lumber off site can create a kit design minimizing measuring, sawing, and specialized labor on site. This can result in faster construction as well as minimized cost.

The use of prefabricated trusses or panels also minimizes construction delays due to the interference of bad weather. Trusses and panels can be constructed in a controlled indoor environment.

Prefabricated roof trusses in particular, generally include multiple pieces of lumber that must be precision cut to specific lengths as well as having precision mitered ends to form tight fitting joints. As depicted in FIG. 1, a typical roof truss includes two top chords TC, a bottom chord BC, several webs WB and may also include wedges WD and overhangs O. Many of these pieces require a preparation of mitered cuts at the ends of the lumber pieces. Many of the pieces will require multiple mitered cuts on an end. Truss plates with teeth are typically utilized to securely make the connection. For a truss to achieve its maximum structural integrity and strength the joints between the various wooden parts should be tight fitting. Thus precision cutting of truss members is quite important to creating a truss that meets engineering standards.

Thus, the process for cutting and mitering truss members, in many circumstances, has been automated for improved precision.

Wood, however, is a natural product and is subject to certain imperfections. Lumber is sawed and planed to size and shape and is also often kiln dried to achieve a desired level of moisture content. As lumber is dried it may acquire a certain degree of warpage or crookedness.

In many or most applications, the length of the cut board with mitered ends is critical. Typically, automated cutting systems make no allowance at all to adjust for warpage or crookedness of lumber members and the length of the board after the mitered cut will often deviate significantly from the specified length such that the board is not usable. This occurs because the miter saw cuts in a plane at an angle with respect to the axis of the board and if the board is crooked upwardly or downwardly, the board will be cut in a different location on the saw blade plane and be longer or shorter than intended. Some automated cutting systems compensate for crooked lumber by forcing crooked lumber pieces to a straight orientation before cuts are made. This is commonly accomplished by the application of force through hydraulic or pneumatic pistons. The problem with this approach is that when the straightening force is released the lumber member will generally spring back to its pre-straightened status. The precisely made cut is then dislocated from its original position and reduces the precision with which trusses assembled from the warped lumber members can be made.

In addition, heavier lumber members such as 2×12 members are very resistant to being forced to a straight orientation. The force required to straighten heavy lumber may exceed the capacity of the equipment to apply it or the lumber may split, crack or break.

The effect of lumber member crookedness on the length of the cut lumber member is limited when cuts are made to the lumber member at or near to ninety-degree angle with respect to the length of the member. However, when mitered cuts are made, lumber member crookedness alters the length of the finished piece significantly. At a forty-five degree cut crookedness essentially alters the finished length in a one to one ratio. As the miter angle is farther from ninety degrees the variation in length becomes larger than the amount of crookedness at a greater rate.

Thus the frame lumber prefabrication industry would benefit from a system to compensate for crooked lumber in automated measuring, cutting and lumber handling equipment.

SUMMARY OF THE INVENTION

The invention relates to an automated saw system for cutting a crooked piece of lumber. The saw system of the invention generally comprises a saw for cutting a piece of lumber at a cutting location. A conveyor is located relative to the saw for feeding the piece of lumber to the saw, and a sensor detects a deviation amount by which the piece of lumber deviates from an idealized straight piece of lumber. A controller is in communication with the sensor and at least one of the saw and the conveyor for adjusting the position of at least one of the saw and the conveyor in response to the detected deviation amount so that the piece of lumber is cut to correspond to a cut of the idealized straight piece of lumber.

In another aspect of the invention, a method for operating the automated saw system comprises conveying a piece of lumber to a saw and detecting a deviation amount by which the piece of lumber deviates from an idealized straight piece of lumber. The method further comprises adjusting the position of at least one of the saw or the piece of lumber to account for said detected deviation amount, and cutting the piece of lumber.

Other features of the invention will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DRAWINGS

Figure 7:
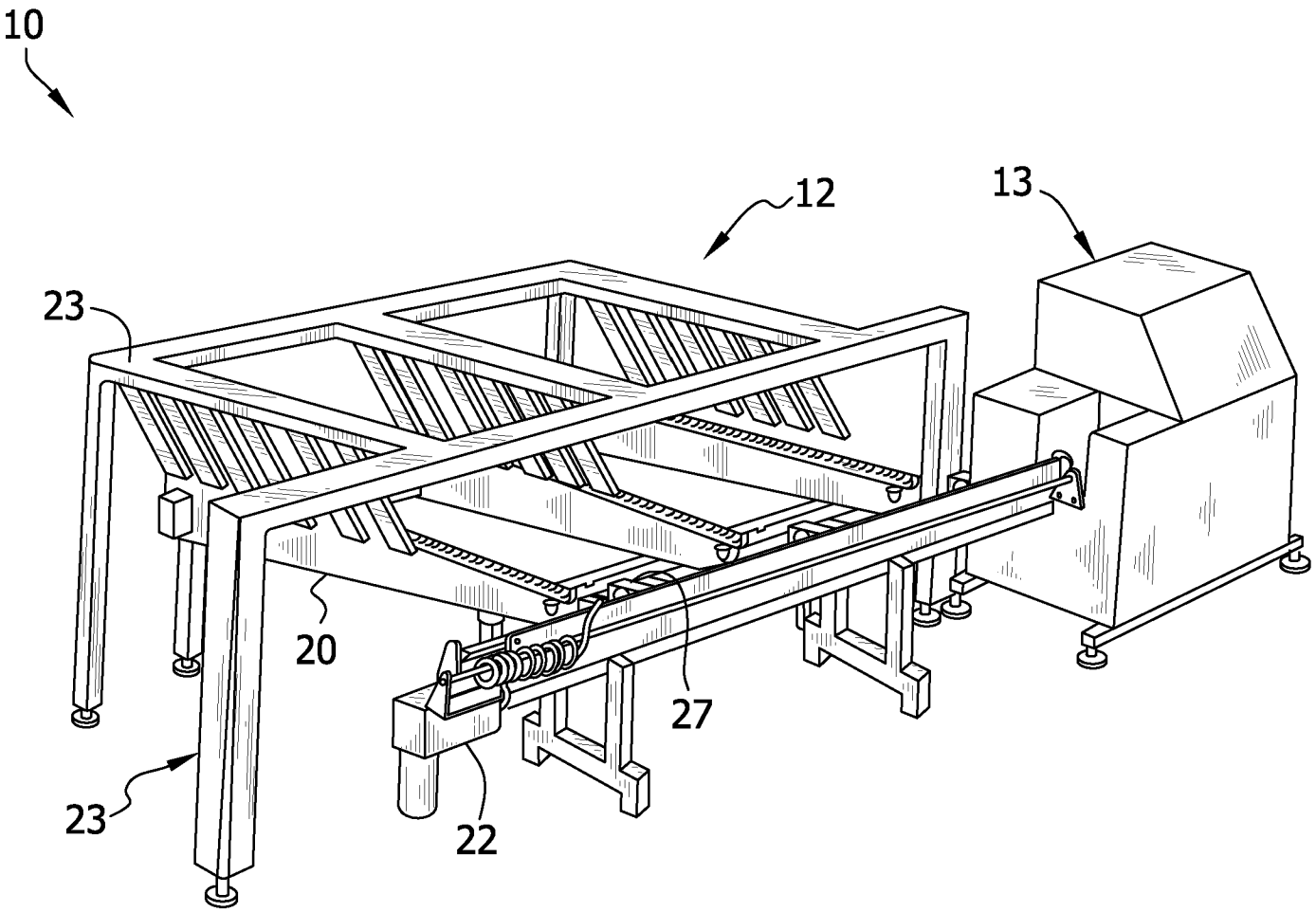
FIG. 7 is a perspective view of an exemplary lumber feed conveyor and miter saw station in accordance with the present invention.

The automated saw system 10 of the present invention is generally depicted in FIGS. 2-4 and 7. As shown in FIG. 7, it generally includes lumber feed conveyor 12 and miter saw station 13. Lumber feed conveyor 12 may include transverse conveyor portion 20 and longitudinal conveyor portion 22. Lumber feed conveyor 12 transports lumber members (not shown in FIG. 7) to the miter saw station 13 for cutting. A magazine feeder 23, a bunk feeder (not shown) or another source of supply for lumber members known in the art may supply lumber members to the feed conveyor 12. Transverse conveyor portion 20 receives lumber members from the magazine feeder 23 and transports them in a direction transverse to their longitudinal axes to the longitudinal conveyor portion 22. Further details of conveyor portions and process controllers may be found in U.S. Pat. No. 6,539,830 and owned by the owner of the instant application and incorporated herein by reference. "Boards", "lumber", and "lumber members" are intended to be interchangeable herein unless the context clearly indicates the contrary.

Figure 1:
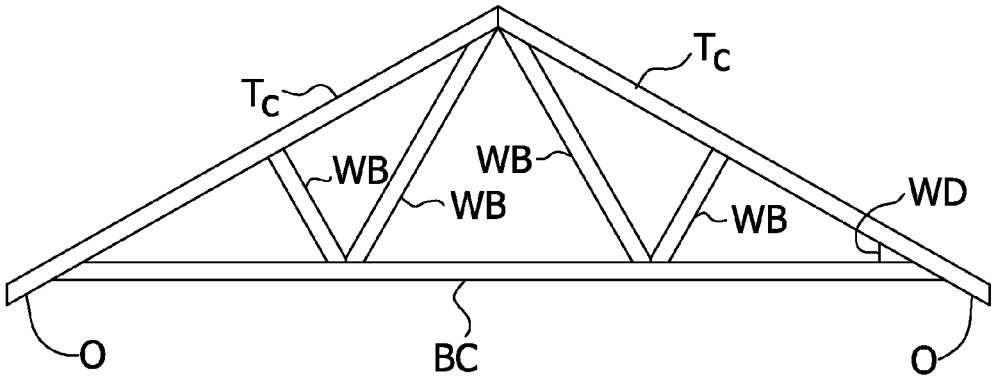
FIG. 1 PRIOR ART
FIG. 1 depicts an exemplary roof truss of the prior art.
Figure 2:
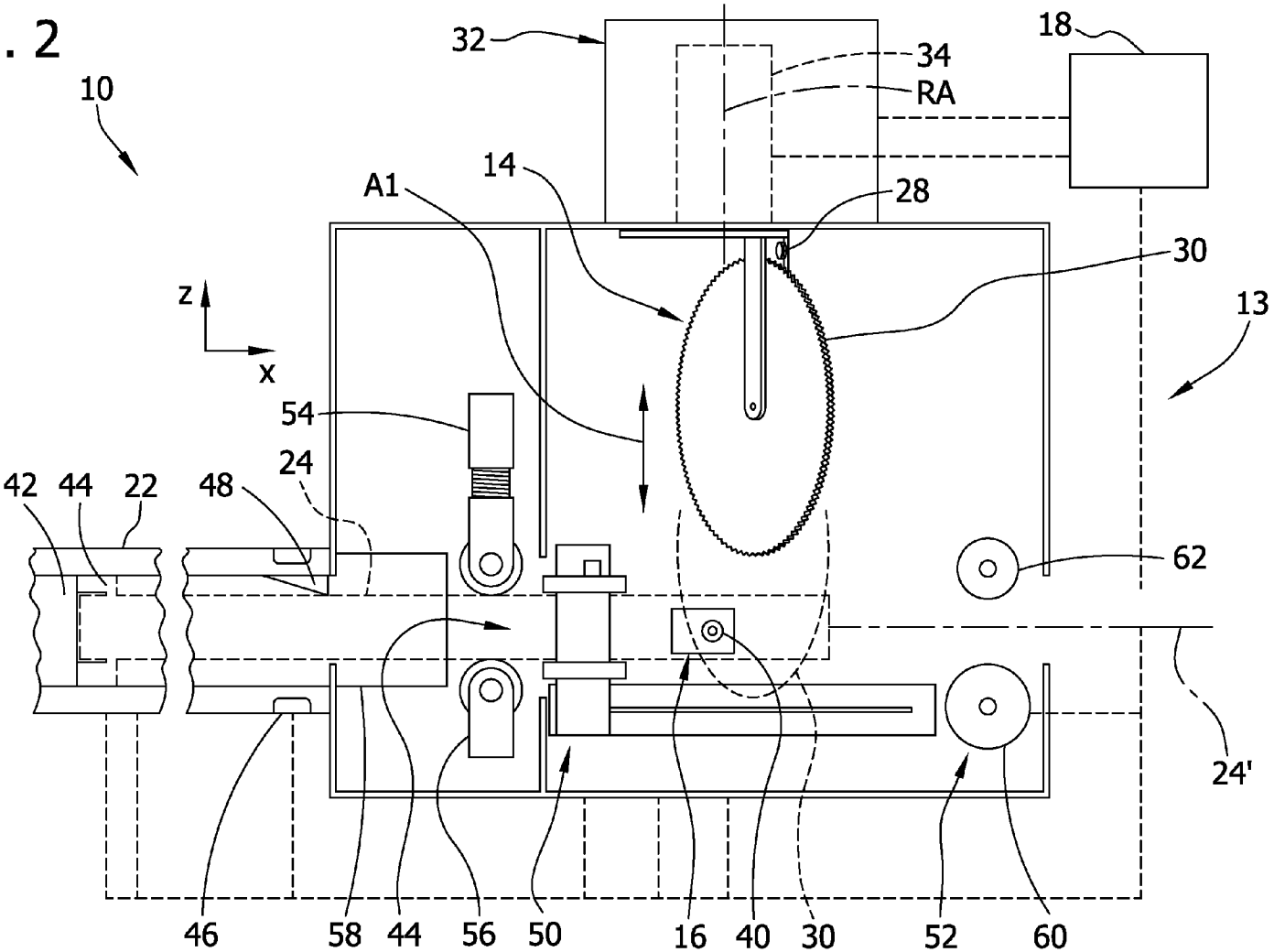
FIG. 2 is a schematic plan view of an automated saw system including a saw and a crooked lumber sensor in accordance with the present invention.

Longitudinal conveyor portion 22 transports lumber members in a longitudinal direction parallel to their longitudinal axes (in an "x" direction as seen in FIG. 2, which illustrates a longitudinal axis 24' of an idealized straight lumber member 24), to the miter saw station 13. Longitudinal conveyor portion 22 may include gripper 27 that grips a rearward or trailing end of a respective lumber member and precisely positions it for placement of cuts along the lumber member.

Figure 3:
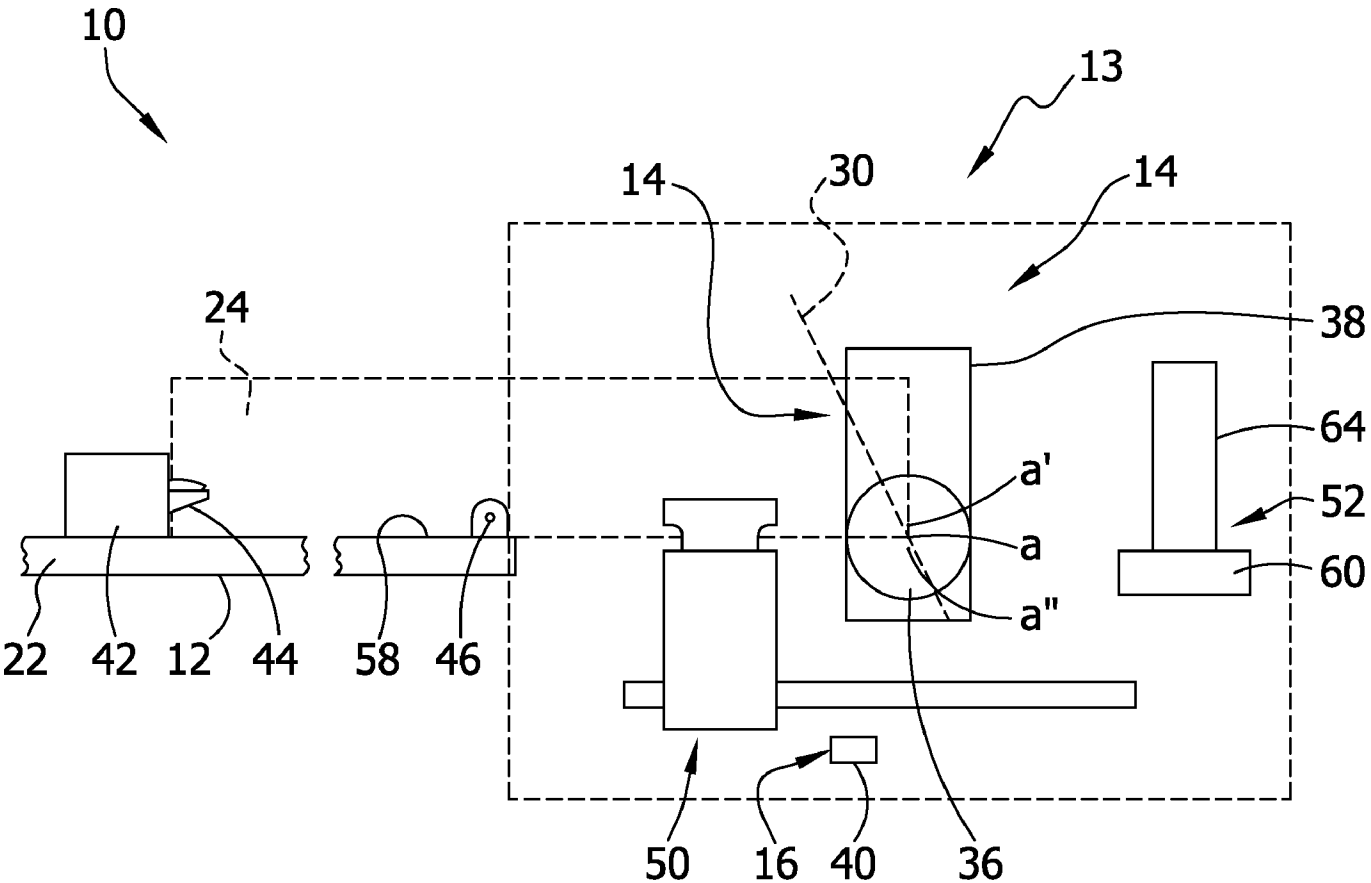
FIG. 3 is a schematic elevation view of the automated saw system.
Figure 4:
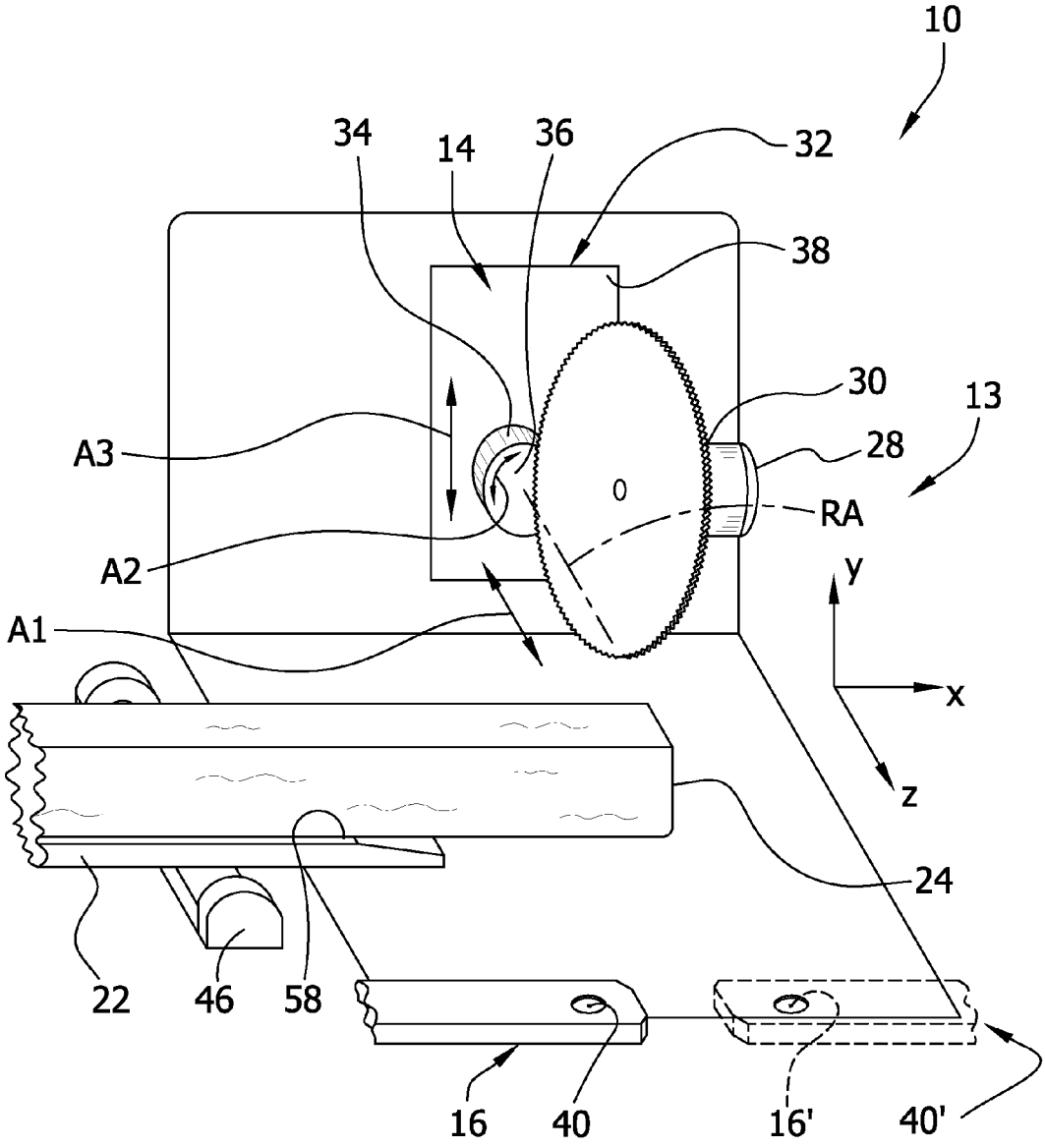
FIG. 4 is an enlarged fragmentary perspective view of the automated saw system particularly showing the crooked lumber sensor and saw.

Referring to FIGS. 2-4, the miter saw station 13 generally includes saw 14, crooked lumber sensor 16, and process controller 18. The saw 14 generally includes motor 28, blade 30 and support 32. Saw motor 28 drives saw blade 30. Saw 14 may be a circular-saw based saw as depicted herein, however it is to be understood that saw 14 may include other types of motorized saws or cutters such as a band saw or a reciprocating saw. Saw motor 28 may be linked to saw blade 30 via a transmission or reduction drive (not shown.)

Saw support 32 generally includes cutting stroke piston 34, angle adjuster 36, and elevation adjuster 38 (FIG. 4). Cutting stroke piston 34 may be a pneumatic piston, hydraulic piston, or another form of electromechanical operator that moves saw blade 30 in a cutting stroke as indicated by arrow A1 which is in the "z" direction. This is substantially perpendicular to the path of movement of the lumber members 24 through the miter station 13. Movement of the saw blade 30 is indicated by the saw blade shown in dashed lines in FIG. 2.

Angle adjuster 36 may rotate saw blade 30 about adjustment axis RA, as indicated by arrow A2 in FIG. 4, which is substantially parallel to the direction of the cutting stroke. This can also be accomplished by rotating the cutting stroke piston 34. In other words, the piston can rotate for angle adjustment of the miter and also perform the cutting stroke. Desirably angle adjuster 36 is capable of adjusting saw blade 30 between positions (miter angles) from about 2 degrees from the horizontal through a 90 degree angle to about 178 degrees from the horizontal. Angle adjuster 36 may be based upon pneumatic, hydraulic, electric motor or another suitable actuator adjusting the angle of saw blade 30. Such means are known in the art. Thus the saw blade 30 is moveable in a cutting stroke with adjustment to a miter angle.

Elevation adjuster 38 adjusts the height of saw blade 30 relative to the position of lumber member 24 in the direction as indicated by A3 in FIG. 4, which is in the "y" direction in this embodiment. This direction is substantially perpendicular to the direction of the cutting stroke. Elevation adjuster 38 is desirably adjustable in small increments. For example, elevation adjuster 38 may be adjustable in increments of about 0.030 of an inch or approximately one-thirty-second of an inch or about 0.8 millimeters. The adjuster may be, for example, long belts, rack and pinion mechanism, a servo motor, chain drive or other mechanism to translate servo's rotation to the linear elevation adjustment. The saw blade 30, cutting stroke piston 34, and angle adjuster 36 are preferably all elevated by the elevation adjuster 38.

Crooked lumber sensor 16, as depicted schematically in FIGS. 2-4, generally includes a sensor 40 that generates an analog output. The sensor 40 measures a generally vertical distance in the "y" direction between the sensor and a lumber member 24 thereabove being fed by the longitudinal conveyor portion 22. A signal sent from the sensor is reflected from a closest surface of the lumber member 24 at approximately the location to be cut (the cutting location) and returned to the sensor. Distance sensor 40 may include an ultrasonic, laser or optical distance sensor, mechanical or other known distance measuring means. It may further include an electronic filtering apparatus to filter out interfering acoustical signals from the saw 14. Distance sensor 40 needs to be accurate to within a relatively close tolerance as indicated above, of about 0.030 of an inch or 0.8 of a millimeter. Two crooked lumber sensors 16, 16' may be used (a second sensor 16', having analog sensor 40', is shown for example in broken lines in FIG. 4), having a first sensor on the leading side of the intended saw cut and a second sensor on a trailing side of the intended saw cut. The sensors 40, 40' together communicate with the controller 18 to produce a crookedness profile for the lumber member 24. The profile is used to properly cut the lumber member 24. Additional sensors can also, of course, be located in additional locations on the apparatus to capture more data as to the crookedness of the lumber.

Referring to FIGS. 2 and 3, longitudinal conveyor portion 22 may include carriage 42 supporting end clamp 44. Carriage 42 is operable by the controller 18 and travels longitudinally on longitudinal conveyor portion 22. End clamp 44 is supported by carriage 42 and serves to clamp the rearward or trailing end of a lumber member 24 to position it for cutting.

As shown in FIGS. 2-4, longitudinal conveyor portion 22 may also include end detector 46 (broadly, position sensor). End detector 46 detects the forward or leading end of lumber member 24 as it is conveyed by longitudinal conveyor portion 22. End detector 46 communicates with the controller 18 for moving the carriage 42 to position a piece of lumber 24 with its cutting location in alignment with the saw blade 30. End detector 46 may be an optical, mechanical, or ultrasonic sensor as well as any other sensor known to those skilled in the art.

Longitudinal conveyor portion 22 may also include board diverter 48 (FIG. 2). Board diverter 48 serves to move the leading edge of a lumber member 24 in a direction away from saw 14 thereby appropriately positioning the lumber member with the saw blade 30 for cutting.

As shown in FIG. 2, miter saw station 13 may include spring loaded roller 54 and fixed roller 56. Spring loaded roller 54 pushes lumber member 24 toward fixed roller 56 and serves to stabilize the lumber member 24 during the cutting process.

As shown in FIGS. 2 and 3, miter saw station 13 may also include second longitudinal conveyer 50 and third longitudinal conveyer 52. Second longitudinal conveyor 50 may transport cut portions of lumber members 24 from a first end of miter saw station 13 to a second end of miter saw station 13 and may position such cut lumber for a cut or cuts on the trailing end of said cut lumber member. Third longitudinal conveyor 52 may then transport cut portions of lumber member 24 out of miter saw station 13 for removal by an operator. Third longitudinal conveyor 52 may include driven wheel 60 and idler wheel 62. Driven wheel 60 may be driven by drive motor 64 (FIG. 3). Driven wheel 60 provides impetus to cut portion of lumber members 24 when they exit the miter saw station 13 for removal.

Miter saw station 13 may also include datum surface 58 which supports lumber member 24 and provides a reference distance to crooked lumber sensor 16 for determining the crookedness of lumber member 24.

Figure 8:
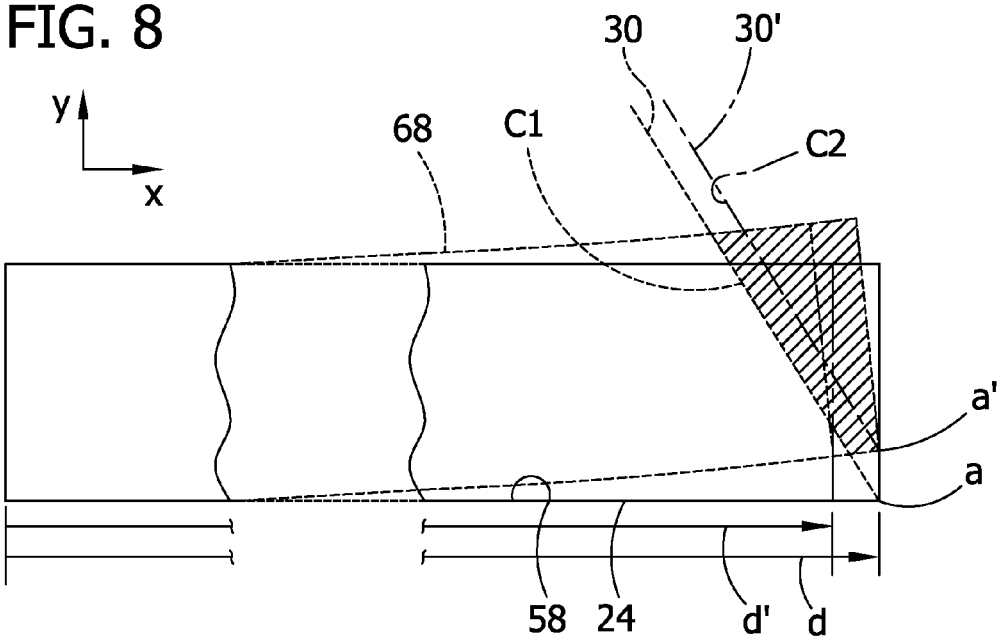
FIG. 8 depicts an idealized straight lumber member compared to a crooked lumber member depicted in phantom.

Referring to FIGS. 2, 3 and 8, the adjustment axis RA of the saw blade 30 normally would be at the bottom end edge a of the idealized straight lumber member 24 as it crosses saw blade 30. Note that a crooked lumber member 68 that bends upward would require the adjustment axis RA of the saw blade 30 be located at end edge a'. A crooked lumber member that bends downward (not shown) may require the adjustment axis RA be at end edge a". When saw blade 30 is adjusted in elevation by elevation adjuster 38, its adjustment axis RA is brought into alignment with either end edge a' for an upward bent lumber member 24 or edge end a" for a downward bent lumber member 24. The saw stroke thus occurs at a higher or lower position relative to the lumber member compensating for the degree of crookedness of the lumber member being cut.

An idealized straight lumber member 24 is shown in FIG. 8 compared to a crooked lumber member 68. Here, as indicated above, idealized straight lumber member 24 requires a cut through the lower leading edge end a. But because the crooked lumber member extends upwardly, performing the miter cut without adjustment (i.e., a cut made with saw 30 and not with adjusted saw 30') would shorten the crooked lumber member 68 by the distance d minus d'. Additionally, rather than a triangular piece cut by the miter station 13, a quadragon as indicated by the cross-hatching results. As can be seen by FIG. 8, the failure of the bottom surface of crooked lumber member 68 to coincide with datum surface 58 can cause considerable variation in the length of the crooked lumber member 68 when there is not suitable compensation for same.

Process controller 18 (shown in FIG. 2) may be a personal computer or another sort of process controller known in the art. Process controller 18 takes the output of distance sensor 40 (FIGS. 2-4) and compares that output to a known distance that would indicate an idealized straight lumber member 24. Process controller 18 then calculates the distance between the distance sensor output and the known distance (broadly, a deviation amount) and, if the variation is greater than the desired tolerance level, sends a signal to elevation adjuster 38 to adjust the elevation of saw blade 30 prior to executing a cutting stroke. The saw blade 30 is raised or lowered an amount substantially equal to the variation. This is done while taking into consideration the miter angle so that the miter cut of the crooked lumber member 68 corresponds to a miter cut of the idealized straight lumber member 24.

For example, referring to FIGS. 2 and 8, if controller 18 determines a crooked lumber member 68 is present, it causes elevation adjustor 38 to raise saw blade 30 to the position of blade 30' and the crooked lumber member 68 receives a cut at c2 rather than at c1. Typically the adjustment axis RA of the saw blade 30 will be at an elevation equal to the board datum level 58 (corresponding to the level of end edge a). But after the elevation adjustment for crookedness of board member 68, the adjustment axis RA is at a'. Thus, the crooked lumber member 68 is cut to correspond to a cut of the idealized straight piece of lumber 24 and will have a correct length d and a correct miter end cut.

In an alternate embodiment of the invention, the process controller 18 can compensate for the crookedness of lumber members 24 by adjusting the longitudinal position, that is, forward-rearward position of the lumber member 24 prior to executing a cutting stroke. In this embodiment, the process controller 18 calculates the length variation that a measured amount of crookedness of the lumber member 24 will cause based on well-known trigonometric relationships and calculates a horizontal position adjustment that compensates for the amount of crookedness. Referring to FIG. 8, rather than elevating the saw blade 30 such that adjustment axis RA goes from a to a", the board is horizontally conveyed in the "x" direction such that the first end of the board is moved backwards from d to d". With the board member repositioned as such, the normal, unadjusted cut c1 by the saw blade 30 may be made through end edge a' with the length of the board remaining the desired length.

Figure 5A:
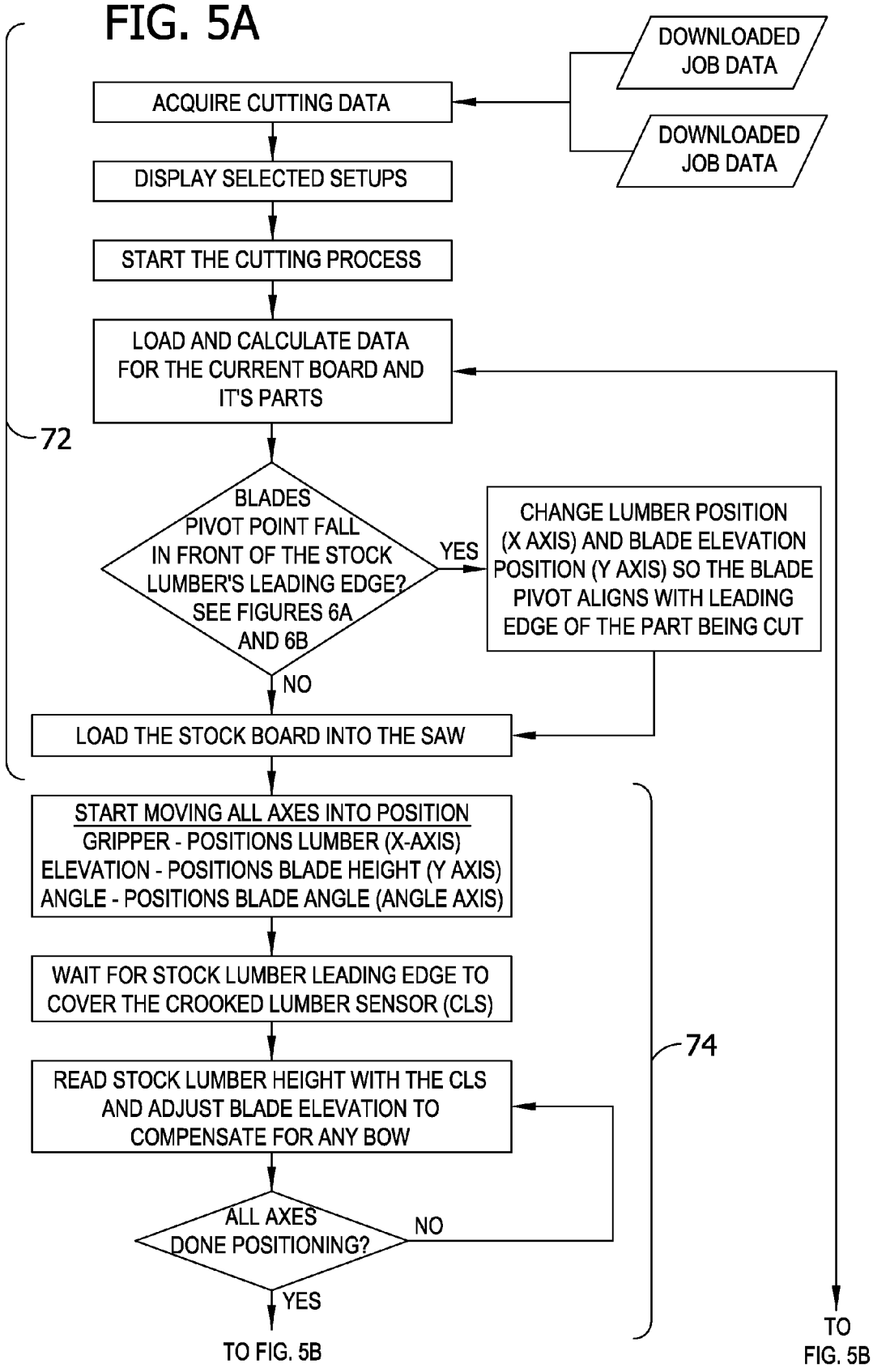
FIG. 5A is a flow chart showing operation of the crooked lumber sensor in accordance with the present invention.
Figure 5B:
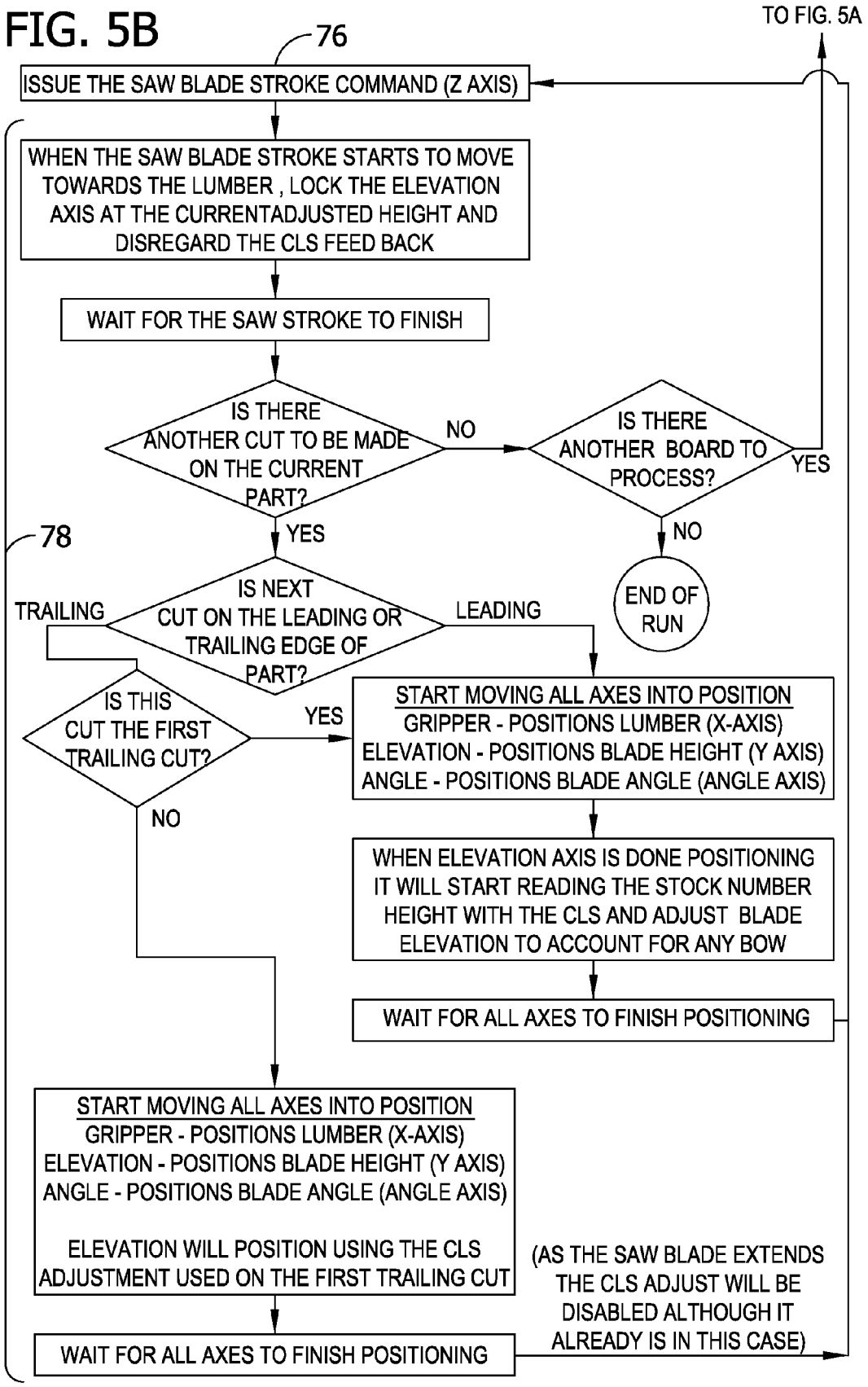
FIG. 5B is a continuation of the flow chart from FIG. 5A.

FIGS. 5A and 5B depict an exemplary flow chart for process controller 18. The process includes first cut positioning steps 72, crooked lumber sensor adjustment steps 74, cutting stroke 76 and subsequent cut steps 78. First cut positioning steps 72 broadly include positioning a new uncut lumber member 24 in the automated saw system 10 and positioning it for a first cut. Crooked lumber sensor adjustment steps 74 broadly include the crooked lumber sensor 16 operations as described above. Cutting stroke 76 broadly includes the execution of a cutting stroke as described above. Subsequent cut steps 78 include the steps for setting up a subsequent cut on an already selected lumber member 24.

Figure 6A:
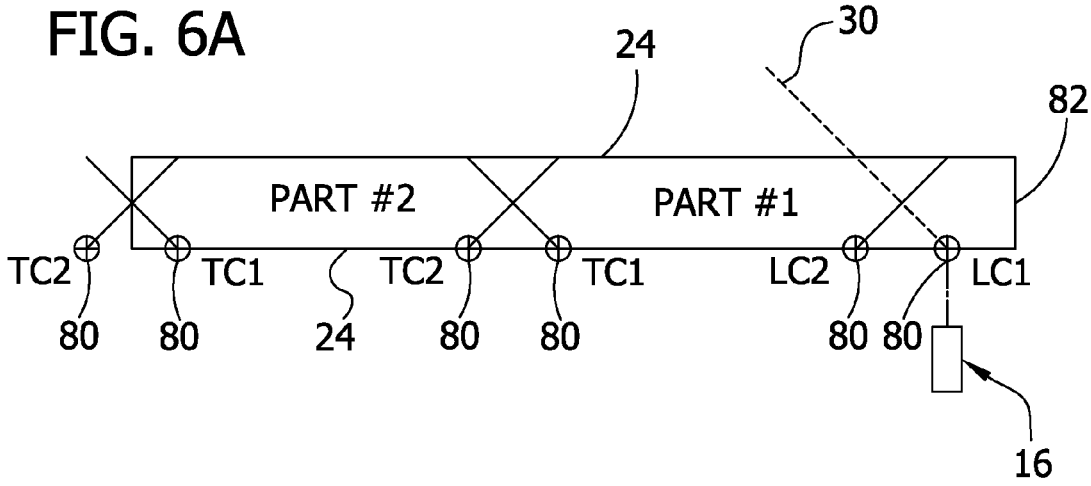
FIG. 6A is a schematic depiction of exemplary cuts to be made in a piece of stock material in accordance with the present invention.
Figure 6B:
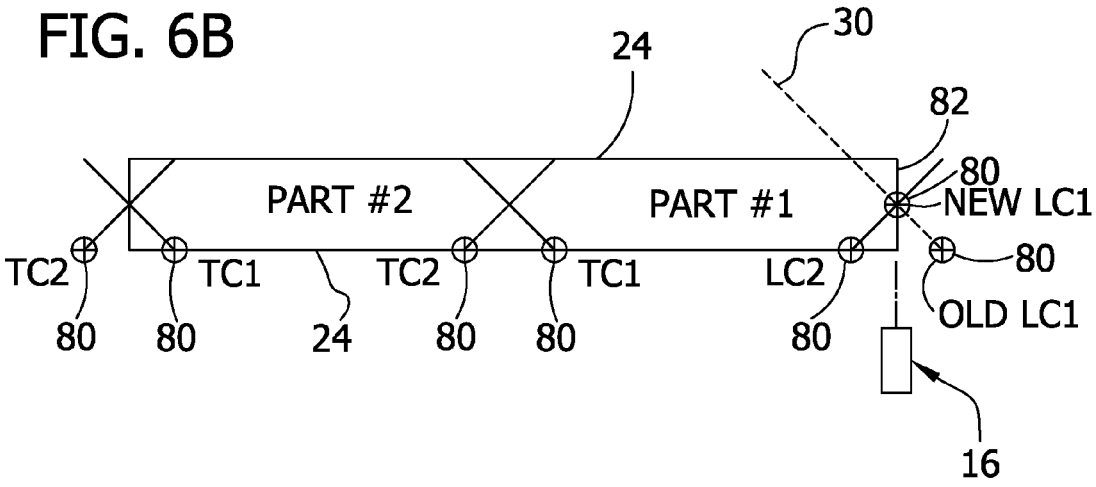
FIG. 6B is the schematic depiction of FIG. 6A with the piece of stock material advanced in a forward direction.

FIGS. 6A and 6B depict an exemplary cutting pattern for several parts to be cut from a lumber member 24 and should be viewed in combination with FIGS. 5A and 5B. FIGS. 6A and 6B are referenced in first cut positioning steps 72. Referring to FIG. 6A, lumber member 24 is presented for cutting such that pivot point 80, corresponding to the adjustable axis RA of saw blade 30, falls on lumber member 24. Under this circumstance a cutting stroke is executed as discussed above to create leading edge cut LC1. The lumber member 24 is then repositioned to make leading edge cut LC2. Lumber member 24 is then repositioned to make subsequent trailing edge cut TC1 and TC2. Referring to FIG. 6B, lumber member 24 is presented for cutting such that pivot point 80 of saw blade 30 falls in front of the leading edge 82 of lumber member 24. If the lumber member 24 is presented in this circumstance it is advanced and the blade elevation is adjusted until pivot point 80 coincides with leading edge 82 of lumber member 24. This approach minimizes waste in the cutting process.

The preferred embodiment described above presumes the board travels longitudinally in the "x" direction and the lumber has its greater size dimension, the height, (in a 2×10, the dimensions corresponding to the 10) oriented upright in the "y" direction, the miter angle being rotated about an axis in the "z" direction and the board's crookedness extending in the "y" direction. Thus the crookedness compensation of the preferred embodiment is the saw elevation adjuster 38 that moves vertically in the "y" direction. If the lumber had the greater size dimension in the "z" direction, the crookedness adjustment would accordingly be in the "z" direction also.

Two distinct operations for compensating for crooked lumber while maintaining the length of the lumber during miter cuts are presented. The crookedness or deviation from an idealized straight board is determined and the saw location is modified by altering either the relative positioning of the board or the saw such that the final end-to-end dimensions of the board meet specific parameters.

In other embodiments, a slight miter angle adjustment may be made to both ends of the board to compensate for the fact that the length of the board, from cut end to cut end, is slightly different than the length of the board as measured along the crooked board. Additionally, the miter angle may be slightly adjusted during the repositioning of the miter saw for compensating for crookedness so that the mitered cuts are precisely oriented to the end-to-end length of the board rather than oriented to the axis of the crooked board. In most cases, this variation is within appropriate tolerances such as provided by ANSI/TPI 1-2002, Quality Criteria for the Manufacture of Metal Plate Connected Wood Trusses.

In the case of wide lumber members having a substantial vertical extent it may be desirable to make multiple cuts in the lumber member. Such can be accomplished by both moving the board longitudinally and adjusting the vertical elevation of the saw.

In further embodiments, the computerized controller may be programmed to discharge boards that exceed a specific crookedness as measured by the height deviation rather than attempting to compensate for the crookedness. Or the process controller can alter the specific pieces to be cut from a specific board depending on the board's crookedness.

An advantage of the invention is that lumber that heretofore would have to be discarded or used only for shorter pieces can now be utilized for mitered cuts for longer members in trusses and the like.

In view of the above, it will be seen that the several features of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. An automated saw system for cutting a crooked piece of lumber having a width, the saw system comprising:

a saw support;

a saw mounted on the support for cutting a piece of lumber at a cutting location;

a cutting stroke piston operatively connected to the saw for movement of the saw in a cutting stroke to cut the piece of lumber;

a conveyor located relative to the saw for feeding the piece of lumber to the saw along a conveyor axis, the saw and the conveyor being arranged so that the piece of lumber fed to the saw is cut through the piece's width;

a sensor mounted on the saw system relative to the saw for detecting a deviation amount by which the piece of lumber deviates from an idealized straight piece of lumber;

a controller in communication with the sensor and one of the saw and the conveyor, the controller adjusting the position of one of the saw and the piece of lumber on the conveyor in response to the detected deviation amount so that the piece of lumber is cut through the piece's width to correspond to a cut of the idealized straight piece of lumber; and an adjuster operatively connected to the controller and the saw for varying a position of the saw relative to the conveyor in an adjustment direction along an axis substantially perpendicular to the conveyor axis and extending vertically in a plane substantially perpendicular to a horizontal plane including the conveyor axis, the varying of position by the adjuster being independent of the cutting stroke movement of the saw by the cutting stroke piston.

2. An automated saw system as set forth in claim 1 wherein the controller is in communication with the sensor and with the adjuster, the adjuster adjusting the position of the saw in response to said detected deviation amount.

3. An automated saw system as set forth in claim 2 wherein the deviation amount is a distance measured from the sensor to the piece of lumber minus a corresponding distance measured from the sensor to an idealized straight piece of lumber.

4. An automated saw system as set forth in claim 3 wherein the adjuster adjusts the position of the saw relative to the conveyor by a distance proportional to said deviation amount.

5. An automated saw system as set forth in claim 2 wherein the saw is moveable in a cutting direction substantially perpendicular to said adjustment direction for cutting the piece of lumber, the saw being further moveable in an angular direction about an axis substantially parallel to said cutting direction for producing a mitered end on the piece of lumber.

6. An automated saw system as set forth in claim 1 wherein the controller is in communication with the sensor and the conveyor and wherein the detected deviation amount is a distance measured from the sensor to the piece of lumber minus a corresponding distance measured from the sensor to an idealized straight piece of lumber, the conveyor moving the piece of lumber in a longitudinal direction for adjusting the position of the piece of lumber relative to the saw in response to said detected deviation amount.

7. An automated system as set forth in claim 6 wherein the saw is moveable relative to the support in a cutting direction substantially perpendicular to said longitudinal direction and in an angular direction about an axis substantially parallel to said cutting direction for cutting the piece of lumber with a mitered end.

8. An automated saw system as set forth in claim 1 wherein the controller signals one of the adjuster and the conveyor to adjust the position of one of the saw and the piece of lumber so that the piece of lumber is cut to a length substantially the same as a correspondingly cut idealized straight piece of lumber.

9. An automated saw system as set forth in claim 1 wherein the controller adjusts the position of one of the saw and the piece of lumber on the conveyor so that the piece of lumber is cut with a mitered end substantially the same as a correspondingly cut idealized straight piece of lumber.

10. An automated saw system as set forth in claim 1 wherein the sensor comprises first and second sensors, the first sensor detecting a first deviation amount on a leading side of said cutting location and the second sensor detecting a second deviation amount on a trailing side of said cutting location, the controller using both the first and second deviation amounts to adjust the position of one of the saw and the piece of lumber on the conveyor.

11. An automated saw system as set forth in claim 1 wherein the sensor comprises an ultrasonic distance sensor.

12. An automated saw system as set forth in claim 11 wherein the sensor further comprises an electronic filtering apparatus to filter out interfering acoustical signals from the saw.

13. An automated saw system as set forth in claim 1 further comprising a carriage and a position sensor associated with the carriage, the carriage being operable by the controller for moving the piece of lumber along the conveyor and the position sensor determining the position of the piece of lumber to be cut, the controller communicating with the position sensor and the carriage to position the piece of lumber with the piece's cutting location in alignment with the saw.

14. A method for cutting a crooked piece of lumber having a width, the method comprising the steps of:

conveying a piece of lumber to a saw along a conveying axis;

detecting a deviation amount by which the piece of lumber deviates from an idealized straight piece of lumber; and adjusting the position of one of the saw or the piece of lumber to account for said detected deviation amount along an axis substantially perpendicular to the conveying axis and extending vertically in a plane substantially perpendicular to a horizontal plane including the conveying axis;

cutting the piece of lumber through the piece's width by moving the saw in a cutting stroke, said cutting stroke movement being independent of adjusting the position of the saw.

15. A method as set forth in claim 14 wherein the adjusting step comprises adjusting the position of the saw.

16. A method as set forth in claim 15 wherein detecting said deviation amount comprises measuring a distance to the piece of lumber from a sensor and comparing said distance to a corresponding distance measured to an idealized straight piece of lumber, and wherein adjusting the position of the saw comprises moving the saw a distance proportional to the deviation amount.

17. A method as set forth in claim 14 wherein the adjusting step comprises adjusting the position of the piece of lumber.

18. A method as set forth in claim 14 wherein detecting said deviation amount comprises measuring a distance to the piece of lumber from a sensor and comparing said distance to a corresponding distance measured to an idealized straight piece of lumber.

* * * * *